United States Patent [19]

Lockard

[11] Patent Number: 4,902,241

[45] Date of Patent: Feb. 20, 1990

[54] ELECTRICAL INTERCONNECTION SYSTEM

[75] Inventor: Joseph L. Lockard, Harrisburg, Pa.

[73] Assignee: AMP Incorporated, Harrisburg, Pa.

[21] Appl. No.: 693,225

[22] Filed: Jan. 22, 1985

Related U.S. Application Data

[63] Continuation of Ser. No. 401,197, Jul. 23, 1982, abandoned.

[51] Int. Cl.[4] ..... H01R 4/24

[52] U.S. Cl. ..... 439/395

[58] Field of Search ..... 339/14 R, 14 L, 97 R, 339/97 P, 98, 99 R, 143

[56] References Cited

U.S. PATENT DOCUMENTS

| | | | |
|---|---|---|---|
| 1,290,153 | 1/1919 | Fitzpatrick | 339/98 |
| 1,372,401 | 1/1971 | Wagstaff . | |
| 3,154,363 | 10/1964 | Will | 339/99 R |
| 3,964,816 | 6/1976 | Narozny | 339/99 R |
| 4,065,850 | 1/1978 | Burr et al. | 29/625 |
| 4,118,096 | 8/1927 | Takahashi | 339/99 R |
| 4,169,646 | 10/1979 | Stape et al. | 339/99 R |
| 4,209,215 | 6/1980 | Verma | 339/99 R |
| 4,429,940 | 2/1984 | Freshwater | 339/99 R |

FOREIGN PATENT DOCUMENTS

| | | | |
|---|---|---|---|
| 2031215 | 12/1971 | Fed. Rep. of Germany | 339/98 |
| 2254395 | 5/1974 | Fed. Rep. of Germany | 339/99 R |
| 2052181 | 5/1980 | United Kingdom . | |

*Primary Examiner*—Joseph H. McGlynn

*Attorney, Agent, or Firm*—Adrian J. LaRue; Anton P. Ness

[57] ABSTRACT

An electrical interconnection system comprises a main electrical bus to which branch electrical buses are electrically interconnected. The main bus and branch buses include a plurality of insulated electrical conductors extending crosswise to one another with electrical interconnectors electrically interconnecting selected electrical conductors of the buses together. The electrical interconnectors penetrate the insulation of the buses and make electrical connection with the electrical conductors. The terminated sections of the buses can be housed in housing assemblies providing strain relief and insulation. Shielding can be applied onto the main bus and ground connections can be effected at the housing assemblies.

24 Claims, 7 Drawing Sheets

36
39
39
32
47
47
39
34
68
34
38
38
36
40
42
22
12
10
50
52
62
56
58
62
58
54
64
38
44
40
46
40
38
38
34
60
46
42
42
32
36
36
34

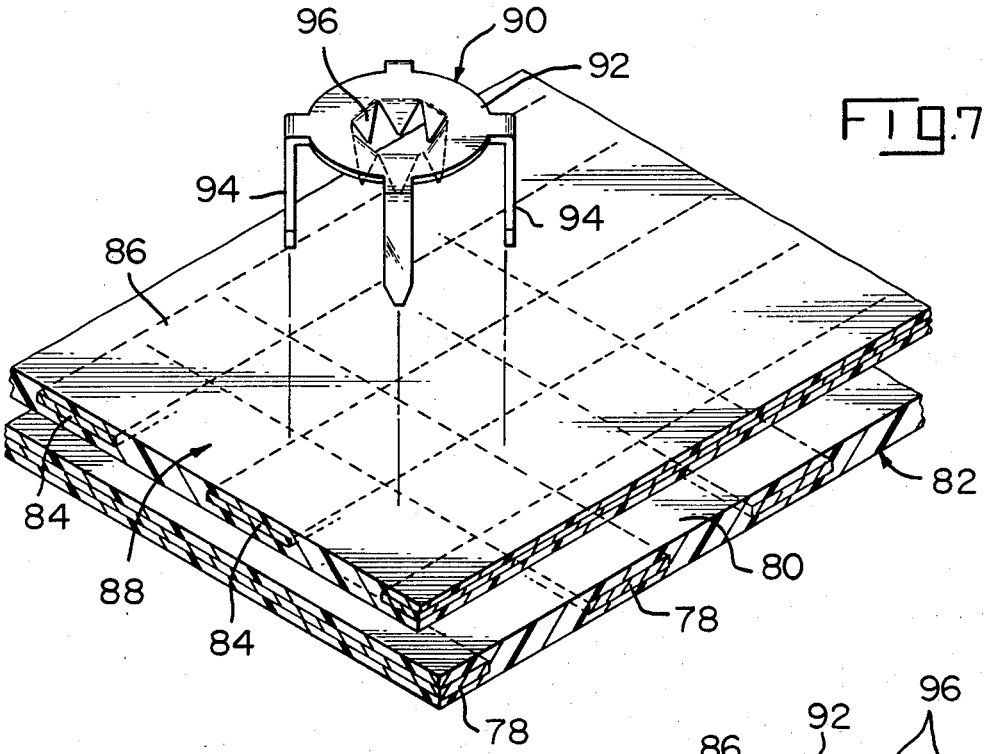
FIG. 7
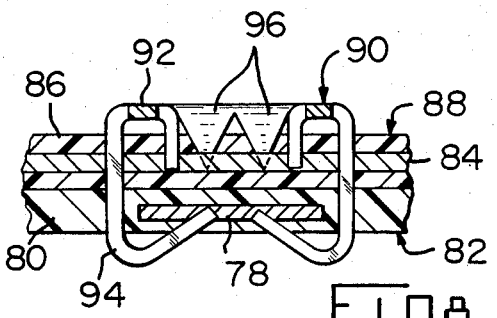
FIG. 8
FIG. 9
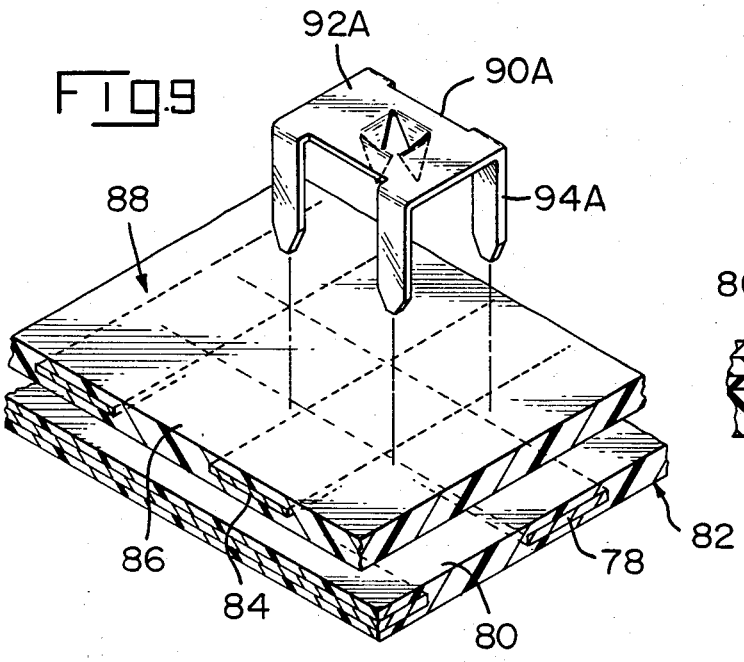
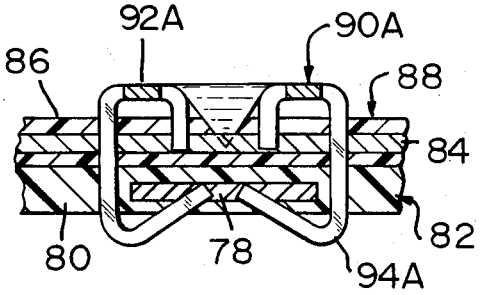
FIG. 10

ELECTRICAL INTERCONNECTION SYSTEM

This application is a continuation of application Ser. No. 401,197 filed July 23, 1982, now abandoned.

FIELD OF THE INVENTION

This invention relates to electrical connection systems and more particularly to electrical interconnection systems.

BACKGROUND OF THE INVENTION

Electrical wiring harnesses are typically assembled from discrete electrical wires that are individually routed to preselected locations and subsequently bundled together. These harnesses are customarily assembled by manual application. Machines have been developed to automatically assemble harnesses. In either case, assembling such wire harnesses is time-consuming and expensive.

SUMMARY OF THE INVENTION

In accordance with the present invention, an electrical interconnection system comprises a main electrical bus to which branch electrical buses are electrically connected. The main bus and branch buses include a plurality of insulated electrical conductors extending crosswise to one another with electrical connectors electrically interconnecting selected electrical conductors of the buses together. The electrical connectors penetrate the insulation of the buses and make electrical connection with the electrical conductors. The terminated sections of the buses can be housed in housing members providing strain relief and insulation. Shielding can be applied onto the main bus, and ground connections can be effected at the housing members.

According to another aspect of the present invention, a method of making an electrical interconnection system comprises the steps of extending a branch electrical bus across a main electrical bus, inserting electrical connectors into the crossed buses at selected locations electrically interconnecting certain electrical conductors of the buses together, and applying insulating housings over the crossed and interconnected buses. Insulation can be secured onto the main bus of the crossed buses thereby covering the exposed sections of the electrical connectors and conductive shielding material is secured onto one surface of the main bus.

BRIEF DESCRIPTION OF THE DRAWINGS

FIG. 7 is a perspective view of another alternative embodiment of an electrical connector exploded from crossed buses.

FIG. 8 is a cross-sectional view of the electrical conductor of FIG. 7 in a terminated condition with electrical conductors of the crossed buses.

FIG. 9 is a perspective view of a further embodiment of an electrical connector exploded from crossed buses.

FIG. 10 is a cross-sectional view of the electrical connector of FIG. 9 in a terminated condition with electrical conductors of the crossed buses.

DETAILED DESCRIPTION OF PREFERRED EMBODIMENTS

Figure 1:
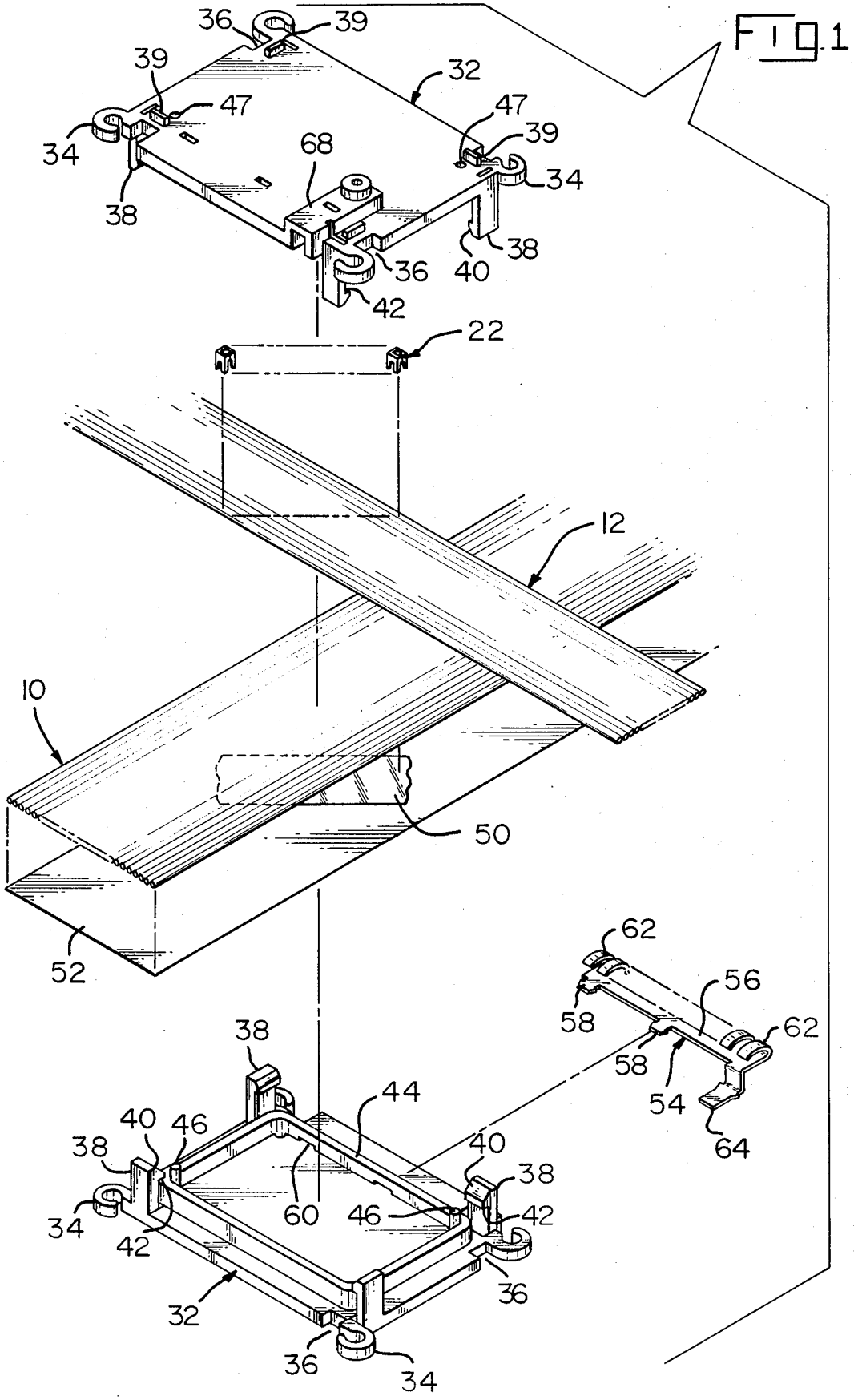
FIG. 1 is a perspective and exploded view of a main electrical bus, branch electrical bus, connectors to selectively interconnect electrical conductors of the buses, and housing members to house the interconnected sections of the buses.

FIGS. 1 through 6 illustrate an electrical interconnection system relating to a main electrical bus 10 to which are electrically interconnected branch electrical buses 12 to form an electrical harness for use in electronic controlled equipment or the like. Main electrical bus 10 is in the form of a multi-conductor cable with electrical conductors 14 disposed in an insulating jacket 16 so that electrical conductors 14 extend parallel to and insulated from one another. Electrical conductors 14 are typically of a size to carry electronic signals therealong in either direction and the conductors can either be stranded or single conductors. Branch electrical buses 12 are of the same construction with electrical conductors 18 covered by insulating jacket 20; branch buses 12 may not have as many conductors as main bus 10.

Part of the electrical conductors in main electrical bus 10 and branch electrical buses 12 can be larger for the purpose of supplying power to electronic equipment if desired.

Figure 3:
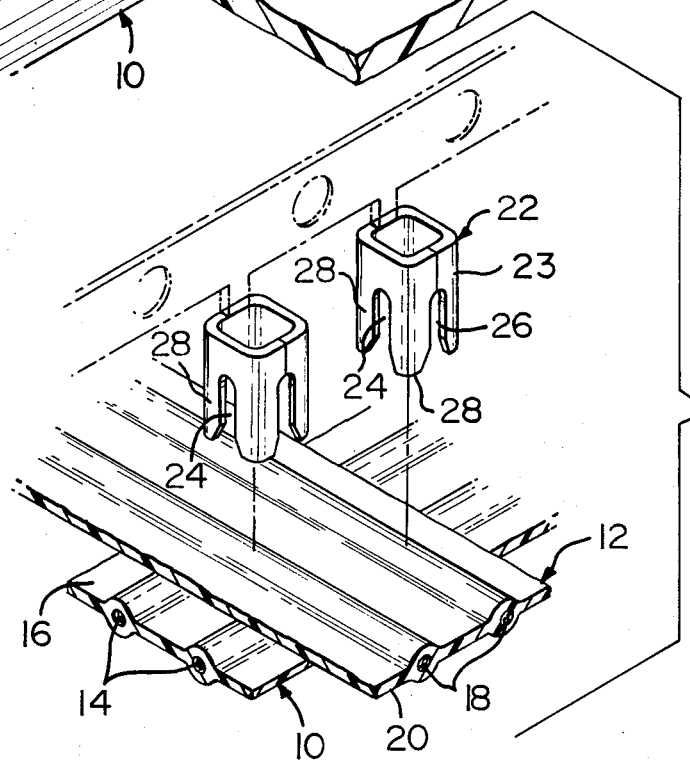
FIG. 3 is a perspective view of parts of crossed buses with electrical connectors exploded therefrom.
Figure 4A:
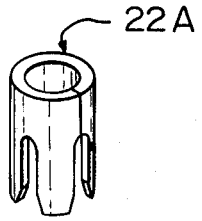
FIG. 4A is a perspective view of an alternative embodiment of the electrical connector.
Figure 4:
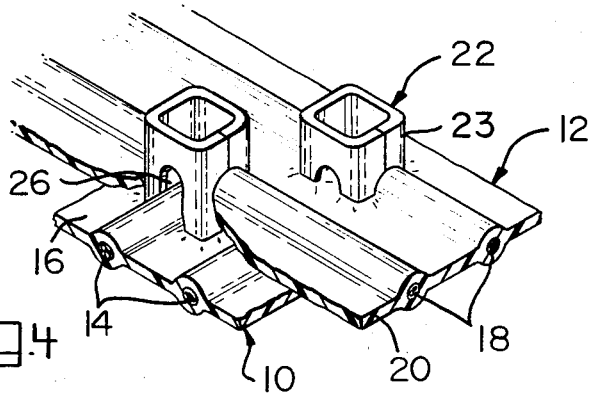
FIG. 4 is similar to FIG. 3 with one of the connectors in a terminated position and the other in a part-terminated position.
Figure 5:
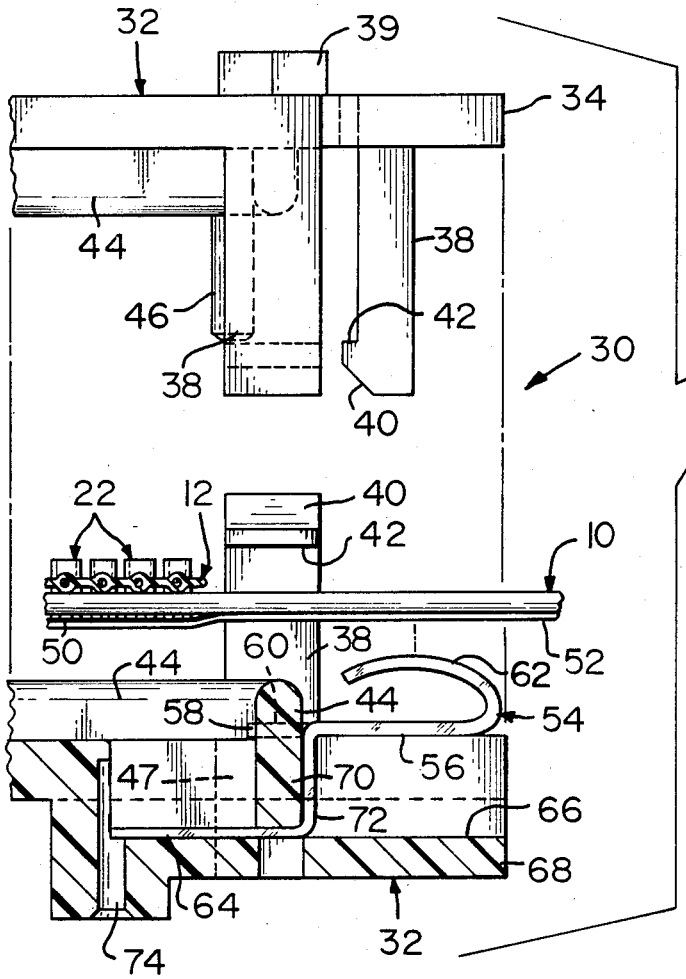
FIG. 5 is a part cross-sectional view of a housing member showing a ground contact with interconnected buses and another housing member exploded therefrom.

FIGS. 3 and 4 best illustrate conductor-interconnecting means such as electrical connectors 22 for electrically interconnecting electrical conductors 18 of branch bus 12 to electrical conductors 14 of main bus 10. Electrical connectors 22 are stamped and formed from a suitable metal strip in strip form and they are formed into a body section 23 having a rectangular configuration with spaced opposing first slots 24 located in substantailly spaced opposing sides and opposing second slots 26 located in the other substantially spaced opposing sides slots 24 and 26 comprising conductor-engaging means to electrically engage conductors 14 and 18 respectively. The entrances to slots 24 and 26 are beveled. Legs 28 have an L-shape in cross section and are located at each of the corners of electrical connectors 22. Electrical connectors 22 can have a round configuration if desired as shown in FIG. 4A.

When it is desired to electrically interconnect selected ones of electrical conductors 18 of branch bus 12 with electrical conductors 14 of main bus 10, legs 28 of electrical connectors 22 are forced through insulating jacket 20 so that slots 24 displace the insulation surrounding electrical conductor 18 and legs 28 penetrate insulating jacket 16 while slots 26 displace the insulation surrounding electrical conductor 14 selected to be connected with electrical conductor 18 thereby electrically connecting the selected conductor together. In this way, electrical conductors of main bus 10 and electrical conductors of branch bus 12 can be selected for interconnection by electrical connectors 22 thereby resulting in a programmed interconnection therebetween in accordance with the needs of the electronic equipment to which branch bus 12 is to be electrically connected by means of a suitable electrical connector (not shown) terminated to the conductors of branch bus 12.

Figure 11:
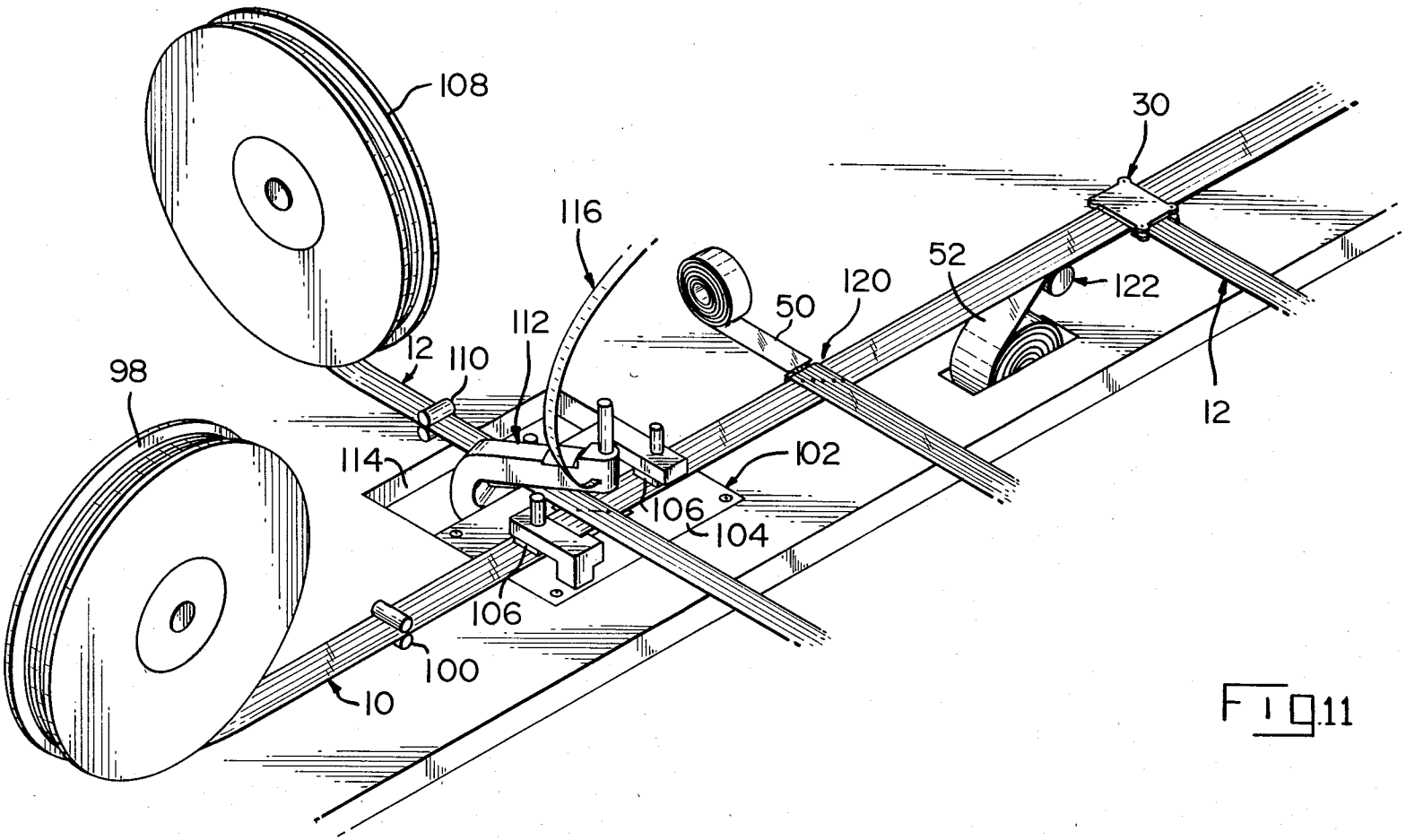
FIG. 11 is a perspective view of a harness making operation for electrically interconnecting branch electrical buses to a main electrical bus.
Figure 12:
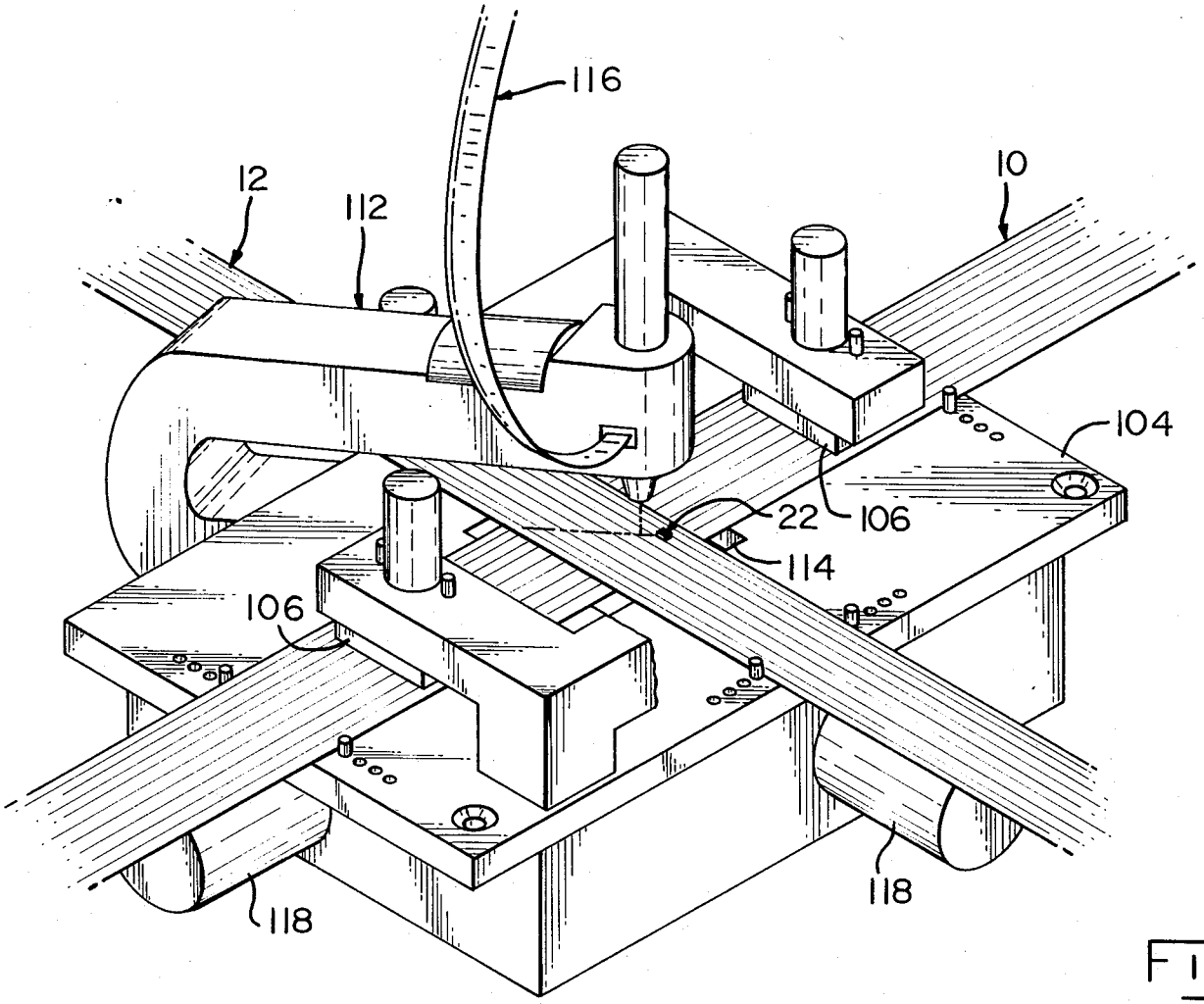
FIG. 12 is a large perspective view of the programmable terminating equipment of FIG. 11.

Electrical connectors 22 in a strip form can be inserted into a terminated position be a program-operated applicator of the type illustrated in FIGS. 11 and 12, legs 28 penetrate through insulating jackets 20, 16 of buses 10, 12 and respectively straddle electrical conductors 18, 14 with slots 24 displacing the insulation covering conductors 18 and making electrical connection with the conductors at two spaced locations therealong, one on each side of a respective conductor 14 crossing thereat, whereas slots 26 displace the insulation covering electrical conductors 14 and also make electrical connection therewith at two spaced locations therealong, one on each side of a respective conductor 18 crossing thereat as illustrated in FIG. 4. In this way, selected conductors 18 of bus 12 are electrically interconnected with selected conductors 14 of bus 10 thereby programmably interconnecting these electrical conductors together in accordance with an established program.

Thereafter, the terminated sections of branch buses 12 to main bus 10 are preferably encased in dielectric means such as housing assembly 30 to protect the terminations and to provide a strain relief, as well as to secure the housing assembly in position to the equipment or within the equipment itself. Housing assembly 30 comprises hermaphroditic cover members 32 molded from a suitable dielectric material. Each cover member 32 includes hook members 34 at each corner with slots 36 and latching members 38 adjacent thereto. Latching members 38 have beveled surfaces 40 and latching surfaces 42. A rectangular wall 44 extends outwardly from an inside surface of cover member 32 and is spaced inwardly from slots 36 and latching member 38. Aligning members 46 also extend outwardly from the inner surface of cover members 32 at opposite corners of wall 44 and they are insertable into holes 47 as cover members 32 are latchably mated together and they serve to align latching members 38 with their respective slots. Bus 10 and buses 12 extend through housing member 30 when cover members 32 are latchably secured together with the terminated areas of the buses disposed within the area defined by walls 44.

Figure 2:
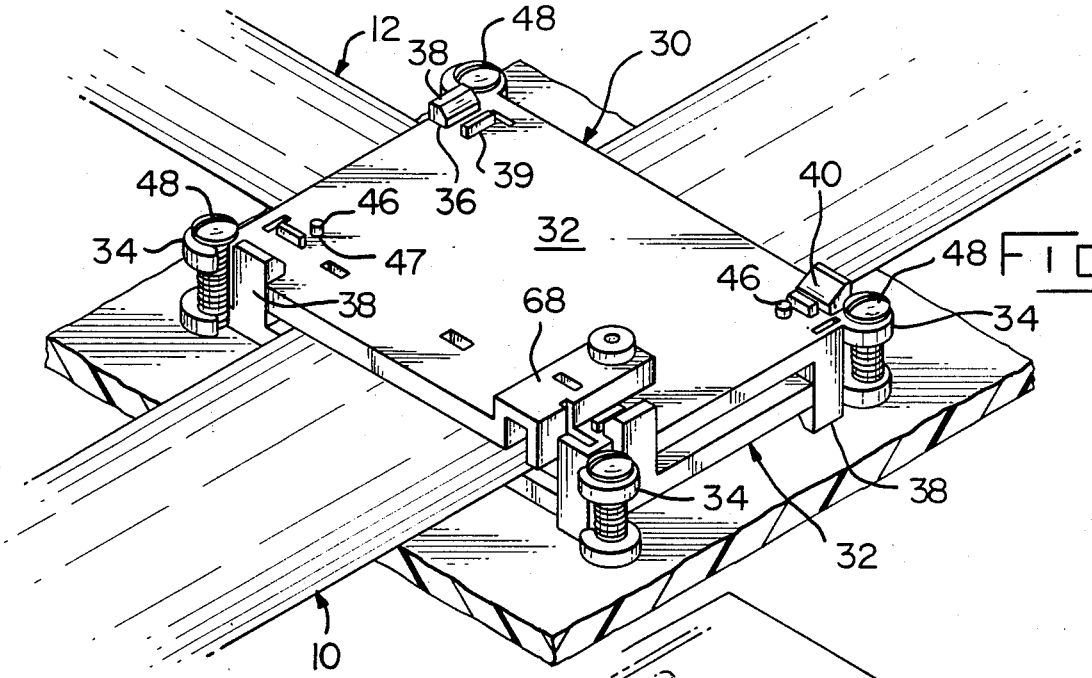
FIG. 2 is a perspective view showing the elements of FIG. 1 assembled.

In operation, a section of branch bus 12 terminated to main bus 10 via electrical connectors 22 is positioned within wall 44 of cover member 32, then another cover member 32 is latchably connected to cover member 32 via latching members 38 positioned in respective slots 36 with latching surfaces 42 engaging the outer surfaces of cover members 32, aligning members 46 and holes 47 aligning respective cover members 32 relative to one another and latching members being aligned relative to respective slots 36 to enable the cover members to be latched together so that bus 12 and bus 10 extend through housing assembly 30 with the terminated areas thereof and electrical connectors being protected and insulated by housing assembly 30. If desired, screws or bolts 48 engage hook members 34 to secure housing assembly 30 in position as illustrated in FIG. 2. Beveled surfaces 40 facilitate movement of latching members 38 outwardly as cover members 32 move together in a matched condition. Projections 39 are spaced inwardly from respective slots 36 and they serve as a surface against which a screwdriver or the like is positioned to apply a force against latching members 38 to move them from a latched position.

After branch electrical buses 12 are terminated to main electrical bus 10 at selected locations therealong via electrical connectors 22, main bus 10 can be shielded if desired to provide a shielded electrical harness that will comply with Federal Communications Commission regulations. To shield main bus 10, a piece of insulating tape 50 is secured onto main bus 10 covering legs 28 of connectors 22 that extend therethrough to insulate them. Thereafter, a sheet of conductive foil 52 having the same width as bus 10 is adhered to bus 10 thereby supplying a shield therefor. Conductive foil can also be applied to branch buses 12.

Figure 6:
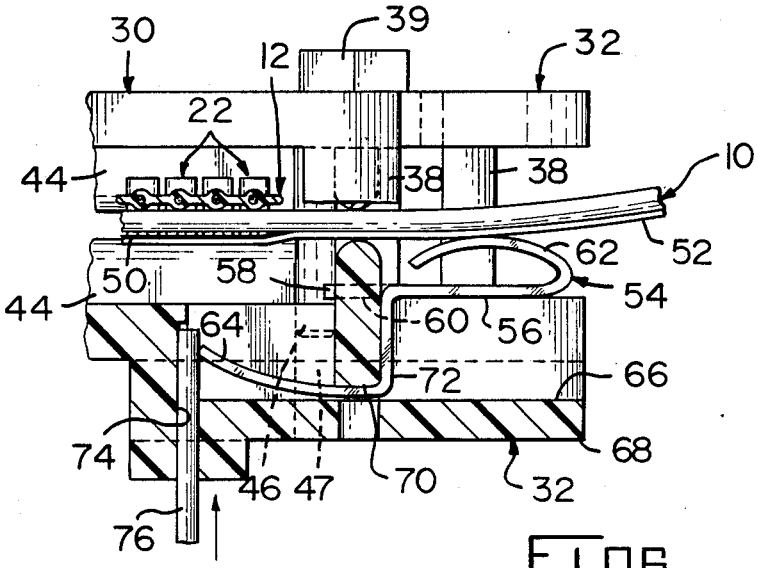
FIG. 6 is a view similar to FIG. 5 in an assembled condition.

Each housing assembly 30 can have secured thereto a grounding contact 54 to ground conductive foil 52 at each of housing assemblies 30 or selected ones thereof as desired. Ground contact 54 comprises an elongated member 56 having securing members 58 that are wedgingly secured in slots 60 located in one side of wall 44. Spring contact fingers 62 are bent back over elongated member 56 for electrical connection with conductive foil 52 when the terminated sections of buses 10, 12 are housed in housing assembly 30 within the walls 44 as illustrated in FIG. 6.

Spring ground contact 64 extends outwardly from elongated member 56 and is positioned along an inside surface 66 of a channel section 68 of cover members 32 with spring ground contact 64 extending between an outer end of an extension 70 of wall 44 which also extends between the sidewalls of channel section 68. A vertical section 72 of contact 64 extends along extension 70. The free end of contact 64 is almost located coincident with the axis of hole 74. A ground wire 76 is inserted into hole 74 through the beveled entrance thereto and is forced against the inner end of channel section 68 by the spring action of spring ground contact 64 as illustrated in FIG. 6 thereby biting into ground wire 76 and securely maintaining ground wire 76 in electrical engagement therewith. Ground wire 76 can then be appropriately connected to a suitable ground. In this way, a number of ground connections can be made for appropriately grounding conductive foil shield 52 at a number of locations.

FIGS. 7 through 10 illustrate alternative embodiments of electrical conductor-interconnecting means for use in conjunction with electrically interconnecting flat conductors 78 insulatively positioned in a parallel orientation in insulating jacket 80 with flat electrical conductors 84 disposed in a parallel orientation in insulating jacket 86 of a branch electrical bus 88, flat electrical conductors 78, 84 crossing one another. Electrical connector 90 illustrated in FIGS. 7 and 8 has a circular body section 92 from which depend legs 94 that are pointed at their outer ends. Triangular shaped members 96 are located centrally of body section 92 and they extend parallel to the axis thereof. Triangular-shaped members 96 comprise first conductor-engaging means to electrically engage top conductor 84, and pointed ends of legs 94 comprise second conductor-engaging means to electrically engage bottom conductor 78, as described below.

Electrical connectors 90 have been formed in accordance with conventional metal stamping and forming practices in strip form if desired and legs 94 are inserted through the insulating jackets of overlapping buses 82, 88 with conductors 78, 84 extending normal to one another so that legs 94 straddle such conductors at a selected point of interconnection so that when electrical connector 90 is moved to a terminating position, legs 94 clear the crossed electrical conductors at such terminating location with triangular shaped members 96 penetrating through insulating jacket 86 into penetrating engagement with conductor 84, thus comprising first conductor-engaging means. Second conductor-engaging means are comprised of the pointed ends of legs 94 which are directed inwardly toward the axis of connector 90 penetrating insulating jacket 80 and penetrating into conductor 78 as illustrated in FIG. 8 thereby electrically connecting these conductors together and also breaking down any oxides therebetween.

Electrical connector 90A of FIGS. 9 and 10 is identical in configuration to electrical connector 90 of FIGS. 7 and 8 except that body section 92A is rectangular in configuration rather than circular; otherwise electrical connector 90A is identical to electrical connector 90 and the termination thereof to terminate conductors 78, 84 is the same as that disclosed in relation to the termination of electrical connector 90 of FIGS. 7 and 8 except that pointed ends of legs 94A are not directed towards the axis of electrical connector 90A.

FIGS. 11 and 12 illustrate a harness making operation for making an electrical harness in an automatic manner under program control. As shown in FIG. 11, main electrical bus 10 is fed from a reel 98 through a cable length sensing station 100 to sense the length of cable that is to be removed from reel 98. Bus 10 is fed to a terminating station 102 at which is located a table 104 along which bus 10 moves and is held in position thereon by hold-down members 106 that can be actuated by electromagnetic means or air- or fluid-operated means. Branch bus 12 is fed from reel 108 across main bus 10 along table 104 with bus 12 passing by cable length sensing station 110 that senses the length of cable that is desired to be removed from reel 108. A program-controlled terminating device 112 operates through an opening 114 in table 104 to automatically insert electrical connectors 22, 90 or 90A from a strip of connectors 116 fed to terminating device 112 from a supply reel (not shown) thereby interconnecting the conductors of buses 10, 12 in accordance with a programmed termination scheme. Electric motors 118 are operationally connected to terminating device 112 to move the terminating dies thereof to their programmed locations for insertion of the electrical connectors into the crossed buses electrically interconnecting selected electrical conductors together.

After bus 12 has been terminated to bus 10, bus 12 is cut from its supply and bus 10 is moved to insulation applying station 120 at which dielectric means such as insulating tape 50 is applied to bus 10 covering the exposed legs of the connectors. Bus 12 is then moved to shield applying station 122 where conductive foil 52 is adhesively secured to the bottom surface of bus 10 whereafter housing assembly 30 is positioned onto the terminated sections of buses 10, 12.

After other branch buses 12 have been terminated to main bus 10, insulating tape 50 applied onto bus 10, conductive foil 52 secured thereto, and housing assemblies 30 secured in position over the terminated sections of the buses, bus 10 is then cut from supply reel 98 and a completed harness has now been made. If desired, only housing assembly 30 can be positioned onto the terminated sections of the buses without applying insulating tape or conductive foil. Insulating tape and foil may be applied to both sides of the main and branch cables.

Figure 13:
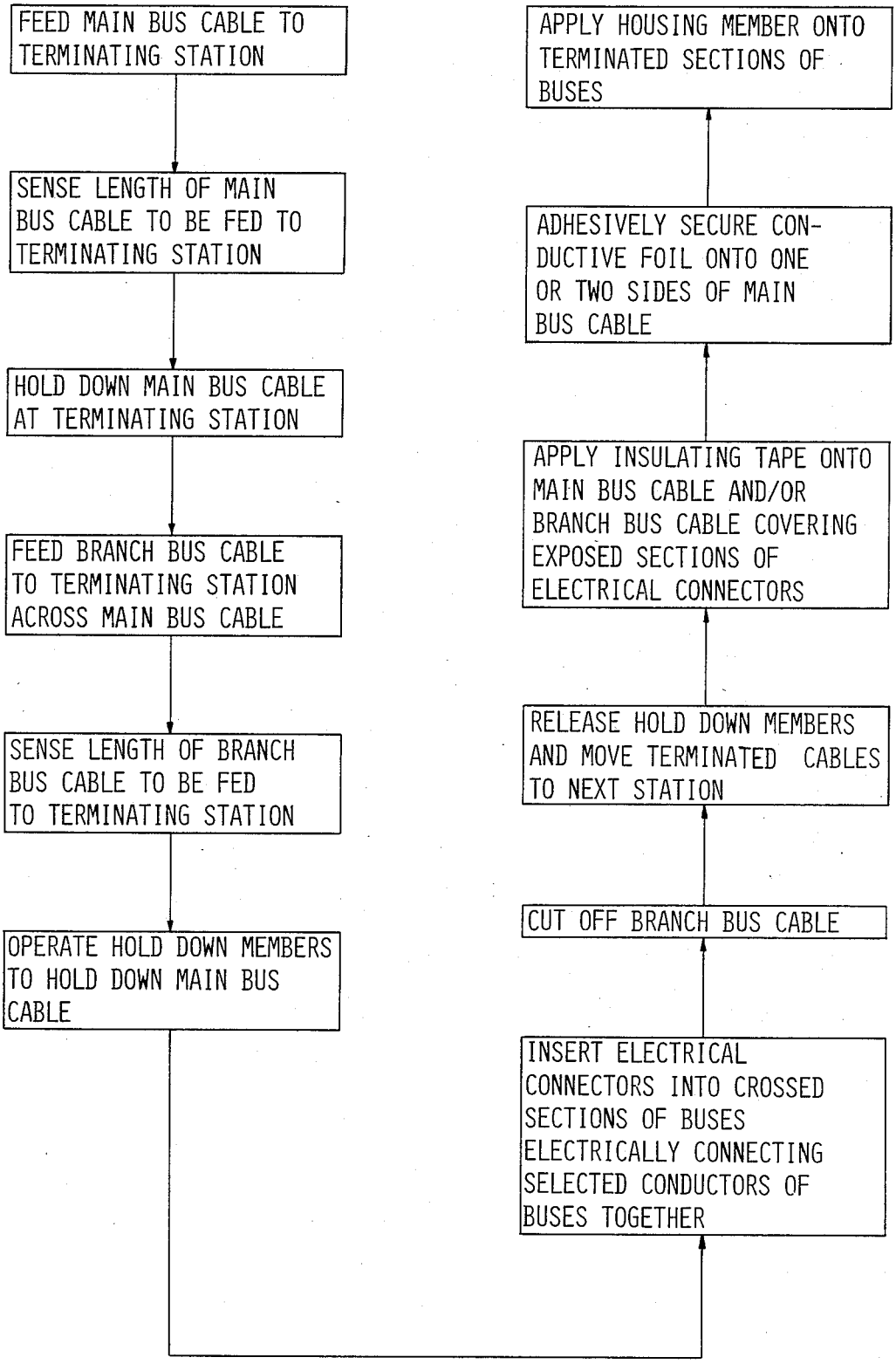
FIG. 13 is a flow diagram of the harness making operation of FIGS. 11 and 12.

FIG. 13 depicts a flow diagram for making a harness in accordance with the equipment illustrated in FIGS. 11 and 12, and the harness making operation can be under the control of a programmable controller that is microprocessor operated. Insulating tape can be applied onto main bus cable and branch bus cable if conductive foil is to be adhesively secured onto both sides of the main bus cable. If conductive foil is secured onto the main bus cable, then grounding contact 54 is included in the housing assembly, which housing assembly is applied after the formation of the electrical interconnections.

What is claimed is:

1. An electrical cable assembly comprising:

an electrical interconnection harness having a main electrical bus means including a multiplicity of electrical conductors isolated from one another by insulating jacket means, a branch electrical bus means including less electrical conductors than said main bus means isolated from one another by insulating jacket means, said branch electrical bus means crossing said main electrical bus means, and further having electrical conductor-interconnecting means each interconnecting a preselected electrical conductor of said branch electrical bus means to a respective preselected electrical conductor of said main electrical bus means at a crossing of said conductors, and dielectric means applied to the terminated section of said harness insulating the electrical interconnections thereof;

said electrical conductor-interconnecting means each having a body section disposed adjacent a first one of said main and said branch electrical bus means at said crossing and four leg members extending substantially downwardly from the periphery of said body section, said four leg members being positioned at substantially spaced locations about said periphery, said four leg members each associated with a respective one of four corners of a respective said crossing and defining conductor-receiving slots therebetween, whereby four-point stability is provided during application of said electrical conductor-interconnecting means to said main and said branch electrical bus means such that no housing is required to support and guide said conductor-interconnecting means during insulating jacket means penetration, each of said leg members penetrating the insulating jacket means of said first one and a second one of said bus means at a respective said corner of said crossing, first conductor-engaging means being disposed on one of said body section and said leg members for electrically engaging a said preselected conductor of said first one of said bus means, and second conductor-engaging means being disposed on at least one of said leg members for electrically engaging a said preselected conductor of said second one of said bus means.

2. An electrical cable assembly as set forth in claim 1 wherein said conductors of said bus means are round and disposed substantially normal to one another and said four leg members of each of said electrical conductor-interconnecting means define four conductor-engaging slots therebetween arranged in substantially spaced pairs of opposed first slots comprising said first conductor-engaging means and opposed second slots comprising said second conductor-engaging means.

3. An electrical cable assembly as set forth in claim 1 wherein said conductors of said bus means are flat and disposed normal to one another, each of said electrical conductor-interconnector means includes triangular-shaped members penetrating through the insulating jacket and into said preselected electrical conductor of said branch bus means while said leg members extend through said insulating jacket means of both said bus means and straddle the crossed electrical conductors thereof with pointed ends of said leg members penetrating back through said insulating jacket means of said main bus into said preselected electrical conductor thereof.

4. An electrical cable assembly as set forth in claim 1 wherein said dielectric means comprises insulation tape applied over exposed sections of said electrical connection means.

5. An electrical cable assembly as set forth in claim 1 wherein said dielectric means comprises insulation tape which covers parts of the electrical conductor-interconnecting means protruding through said main bus means, and conductive foil means is secured to an outer surface of said main bus means with said electrical conductor-interconnecting means insulated therefrom.

6. An electrical cable assembly as set forth in claim 5 wherein housing means is secured around said terminated section of said harness, and ground contact means are mounted on said housing means in electrical engagement with said conductive foil means.

7. A method of making an electrical cable assembly, comprising the steps of:

feeding a main bus cable to a terminating station;

feeding a length of a branch bus cable across said main bus cable;

selectively applying electrical conductor-interconnecting means to the crossed bus cables without previously disposing said conductor-interconnecting means in a housing for support and guidance during said applying, each such means electrically interconnecting a preselected electrical conductor of said branch bus cable to to a respective preselected electrical conductor of said main bus cable by four leg members extending downwardly from the periphery of a body section of said means and being positioned at substantially spaced locations about said periphery, said four leg members each associated with a respective one of four corners of a respective said crossing and defining conductor-receiving slots therebetween, and each penetrating the insulation jackets of both said bus cables at respective said corners of the crossing of said preselected conductors, and first conductor-engaging means disposed on one of said body section and said leg members engaging a said preselected conductor of a first one of said bus cables, and second conductor-engaging means disposed on at least one of said leg members engaging a said preselected conductor of a second one of said bus cables, defining terminated sections of said bus cables;

cutting said branch bus cable; and positioning a dielectric means onto the terminated sections of said bus cables.

8. A method as set forth in claim 7 wherein said dielectric means is insulation tape over exposed sections of the electrical conductor-interconnecting means, said method comprising the additional step of securing a conductive foil onto at least one surface of the main bus cable and the insulation tape.

9. A method as set forth in claim 8 comprising the further steps of:

positioning an insulating housing onto the terminated sections of the buses; and interconnecting the conductive foil with a ground contact in said insulating housing.

10. An electrical conductor-interconnector as set forth in claim 25 for use with flat conductors, wherein said body section has inwardly-directed wedge-shaped members for penetrating the insulation of one of said electrical conductors and being embeddable into said electrical conductors, and said leg members extend outwardly from said body section and have pointed ends for penetrating through the insulation of said first and second crossed electrical conductors straddling them with the pointed ends being bendable back through the insulation covering said second conductor and into penetrating engagement with said second conductor.

11. An electrical conductor-interconnector as set forth in claim 10 wherein said body section is rectangular.

12. An electrical conductor-interconnector as set forth in claim 10 wherein said body section is round.

13. An electrical cable assembly as set forth in claim 1 wherein said dielectric means comprises an insulated housing means.

14. An electrical cable assembly as set forth in claim 13 wherein said insulated housing means comprise hermaphroditic housing members and include latching means latchably securing said housing members together.

15. An electrical cable assembly as set forth in claim 13 wherein said housing means is spaced from said electrical conductor-interconnecting means, and engages said bus means to provide strain relief thereto.

16. An electrical cable assembly as set forth in claim 13 wherein said housing means comprises housing members latchably secured together housing the terminated sections of the bus means.

17. An electrical cable assembly as set forth in claim 16 wherein said housing members are hermaphroditic cover members of insulating material, each of the cover members having a wall, slots and latching members disposed adjacent said wall; and said latching members are adapted to be disposed in respective ones of said slots for latching engagement with said cover members with the terminated sections of said bus means disposed within the opposing walls thereby covering the terminated sections.

18. An electrical cable assembly as set forth in claim 17 wherein hook members are provided on said cover members.

19. An electrical cable assembly as set forth in claim 17 wherein a ground contact member has securing members secured in one of said cover members, spring contact members for electrical engagement with a conductive foil on said main bus means, and a spring contact disposed in a channel section of said one cover member for electrical connection with a ground wire inserted into a hole in said channel section.

20. An electrical cable assembly as set forth in claim 17 wherein aligning members extend outwardly from said cover members for matable engagement with respective holes in said cover members.

21. An electrical conductor-interconnector for electrically interconnecting a first and a second insulated round electrical conductor disposed crosswise of each other, and capable of being applied directly thereto, comprising a body section to be disposed adjacent an insulating jacket of said first conductor and four leg members extending substantially downwardly from the periphery of said body section, said four leg members being positioned at substantially spaced locations about said periphery whereby four-point stability is provided during application of said conductor-interconnector to said first and said second insulated conductors, said four leg members defining four conductor-engaging slots therebetween arranged in substantially spaced pairs of opposing first slots and opposing second slots, such that said opposing first slots are disposed axially normally to said first conductor and said opposing second slots are disposed axially normally to said second conductor, whereby when said conductor-interconnector is applied to said first and second conductors at the point of crossing, said legs penetrate the insulation such that said first slots electrically engage said first conductor on each side of said second conductor and said second slots electrically engage said second conductor on each side of said first conductor.

22. An electrical conductor-interconnector as set forth in claim 21 wherein said body section is rectangular and said legs are L-shaped in cross-section.

23. An electrical conductor-interconnector as set forth in claim 21 wherein said body section is round and said legs are arcuate in cross-section.

24. An electrical conductor-interconnector for electrically interconnecting a first electrical conductor and a second electrical conductor crossed by said first conductor at a crossing, and capable of being applied directly thereto, comprising a body section to be disposed adjacent an insulating jacket of said first conductor at said crossing and four leg members extending substantially downwardly from the periphery of said body section, said four leg members being positioned at substantially spaced locations about said periphery, said four leg members each associated with a respective one of four corners of a respective said crossing and defining conductor-receiving slots therebetween, whereby four-point stability is provided during application of said conductor-interconnector to said first and said second electrical conductors such that no housing is required to support and guide said conductor-interconnector during insulating jacket penetration, each of said leg members penetrating the insulating jackets of said first and said second conductors at a respective said corner of said crossing, first conductor-engaging means being disposed on one of said body section and said leg members for electrically engaging a said first conductor, and second conductor-engaging means being disposed on at least one of said leg members for electrically engaging a said second conductor.

* * * * *

UNITED STATES PATENT AND TRADEMARK OFFICE

CERTIFICATE OF CORRECTION

PATENT NO. : 4,902,241

DATED : February 20, 1990

INVENTOR(S) : Joseph LaRue Lockard

It is certified that error appears in the above-identified patent and that said Letters Patent is hereby corrected as shown below:

IN THE CLAIMS:

Claim 10, line 2 - "claim 25" should read --claim 24--.

Signed and Sealed this

Twenty-first Day of May, 1991

*Attest:*

*Attesting Officer*

HARRY F. MANBECK, JR.

*Commissioner of Patents and Trademarks*